US008162475B2

(12) United States Patent
Sakano

(10) Patent No.: US 8,162,475 B2
(45) Date of Patent: Apr. 24, 2012

(54) INKJET RECORDING APPARATUS

(75) Inventor: Yuji Sakano, Toyota (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 550 days.

(21) Appl. No.: 12/243,905

(22) Filed: Oct. 1, 2008

(65) Prior Publication Data

US 2009/0086001 A1 Apr. 2, 2009

(30) Foreign Application Priority Data

Oct. 1, 2007 (JP) ..... 2007-257224

(51) Int. Cl.
*B41J 1/02* (2006.01)

(52) U.S. Cl. ..... 347/104; 347/101; 347/9

(58) Field of Classification Search ..... 347/103, 347/104, 101

See application file for complete search history.

(56) References Cited

U.S. PATENT DOCUMENTS

| | | | | |
|---|---|---|---|---|
| 7,399,046 | B2 * | 7/2008 | Teshigawara et al. | 347/104 |
| 2004/0119224 | A1 * | 6/2004 | Otsuka | 271/10.03 |
| 2004/0212648 | A1 * | 10/2004 | Arakawa et al. | 347/14 |
| 2008/0291226 | A1 * | 11/2008 | Ishikawa et al. | 346/33 R |

FOREIGN PATENT DOCUMENTS

| | | | |
|---|---|---|---|
| JP | 2005-022820 | A | 1/2005 |
| JP | 2005022820 | A * | 1/2005 |

* cited by examiner

*Primary Examiner* — Manish S Shah
(74) *Attorney, Agent, or Firm* — Baker Botts L.L.P.

(57) ABSTRACT

An inkjet recording apparatus includes: a feeder which contains a recording medium and feeds the recording medium to a conveyer; the conveyer which conveys in a first direction the recording medium fed by the feeder; an inkjet head having an ejection face on which an ejection region is formed, the ejection region having a plurality of ink ejection openings arranged along a second direction perpendicular to the first direction; a detection unit which detects one end of the recording medium in the second direction; and a mover which moves the inkjet head in the second direction in accordance with the position of the one end of the recording medium detected by the detection unit.

7 Claims, 4 Drawing Sheets

INKJET RECORDING APPARATUS

CROSS REFERENCE TO RELATED APPLICATION

This application claims priority from Japanese Patent Application No. 2007-257224, which was filed on Oct. 1, 2007, the disclosure of which is herein incorporated by reference in its entirety.

BACKGROUND OF THE INVENTION

1. Field of the Invention

The present invention relates to an inkjet recording apparatus which records an image on a recording medium.

2. Description of Related Art

Japanese Unexamined Patent Publication No. 2005-22820 (Tokukai 2005-22820) discloses a technique for correcting, in a recording apparatus, a position of a sheet which is a recording medium to an appropriate position with regard to the width direction of the sheet. Specifically, the position of the sheet in the width direction is corrected in such a manner that, when a sheet to be conveyed to an image recording unit is temporarily stopped on a conveyance path, a CCD line sensor measures a deviation amount in the width direction of the sheet, and a pair of rollers grip the sheet therebetween and are slided in the width direction for a distance which corresponds to the deviation amount.

SUMMARY OF THE INVENTION

However, with the technique described in the above-mentioned document, the sheet may be misaligned or an end of the sheet may be creased, when the rollers are slided to correct the position. In such a case, it is not possible to record an image at a desired position on the sheet.

An object of the present invention is to provide an inkjet recording apparatus which is capable of conducting recording at a desired position on a recording medium without causing misalignment or crease of the recording medium.

According to an aspect of the present invention, provided is an inkjet recording apparatus including: a feeder which contains a recording medium and feeds the recording medium to a conveyer; the conveyer which conveys in a first direction the recording medium fed by the feeder; an inkjet head having an ejection face on which an ejection region is formed, the ejection region having a plurality of ink ejection openings arranged along a second direction perpendicular to the first direction; a detection unit which detects one end of the recording medium in the second direction; and a mover which moves the inkjet head in the second direction in accordance with the position of the one end of the recording medium detected by the detection unit.

In this aspect, even if the recording medium being conveyed is deviated to the second direction before the recording is conducted by the inkjet head, the mover moves the inkjet head in accordance with the detected position of the one end of the recording medium, so that position correction is performed. Therefore, misalignment or crease of the recording medium is avoided, which may occur when the position is corrected by sliding a pair of rollers which grip the recording medium therebetween. This makes it possible to conduct recording at a desired position on the recording medium.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

In the followings, a preferred embodiment of the present invention will be described with reference to the accompanying drawings.

Figure 1:
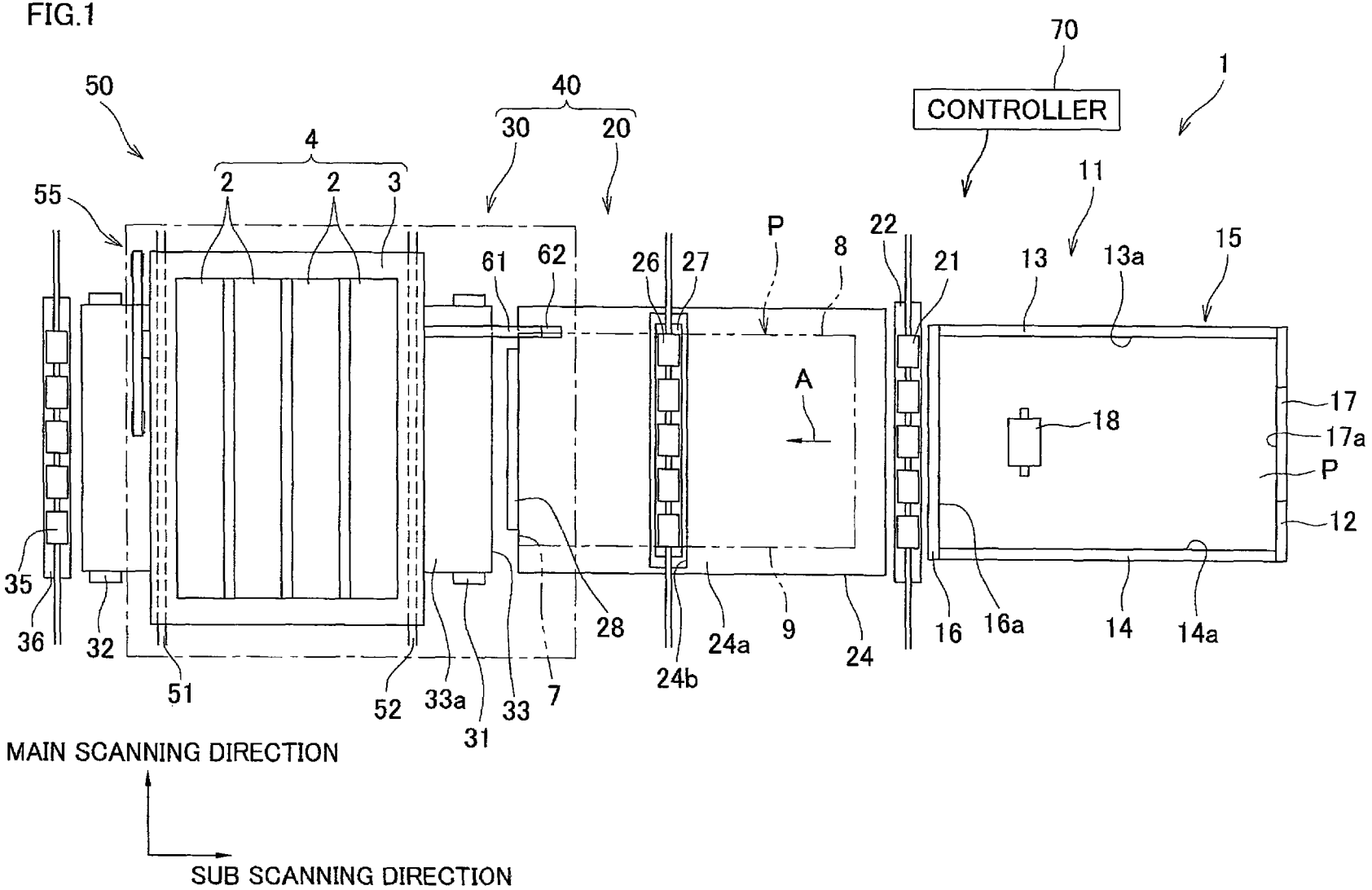
FIG. 1 is a schematic plan view of an inkjet printer according to an embodiment of the present invention.

As shown in FIG. 1, an inkjet printer 1 according to an embodiment of the present invention is a color inkjet printer having four ink jet heads 2. The printer 1 is provided with a paper feeder 11 (to the right in FIG. 1), and a not-shown paper discharger (to the left in FIG. 1). Between the paper feeder 11 and the paper discharger, there is provided a conveyer 40 which conveys a sheet P sent out from the paper feeder 11 in a conveyance direction A which is from the right to the left in FIG. 1. Further, the printer 1 has: a head mover 50 which moves the inkjet heads 2 in a direction perpendicular to the conveyance direction A and parallel to the sheet P, that is the width direction of the sheet P; and a controller 70. The controller 70 controls the operation of the heads 2, the conveyer 40, the head mover 50, or the like.

A sub scanning direction is a direction parallel to the conveyance direction A, and corresponds to the longitudinal direction of the sheet P. A main scanning direction is a direction perpendicular to the sub scanning direction and parallel to a horizontal surface, and corresponds to the width direction of the sheet P.

Figure 2:
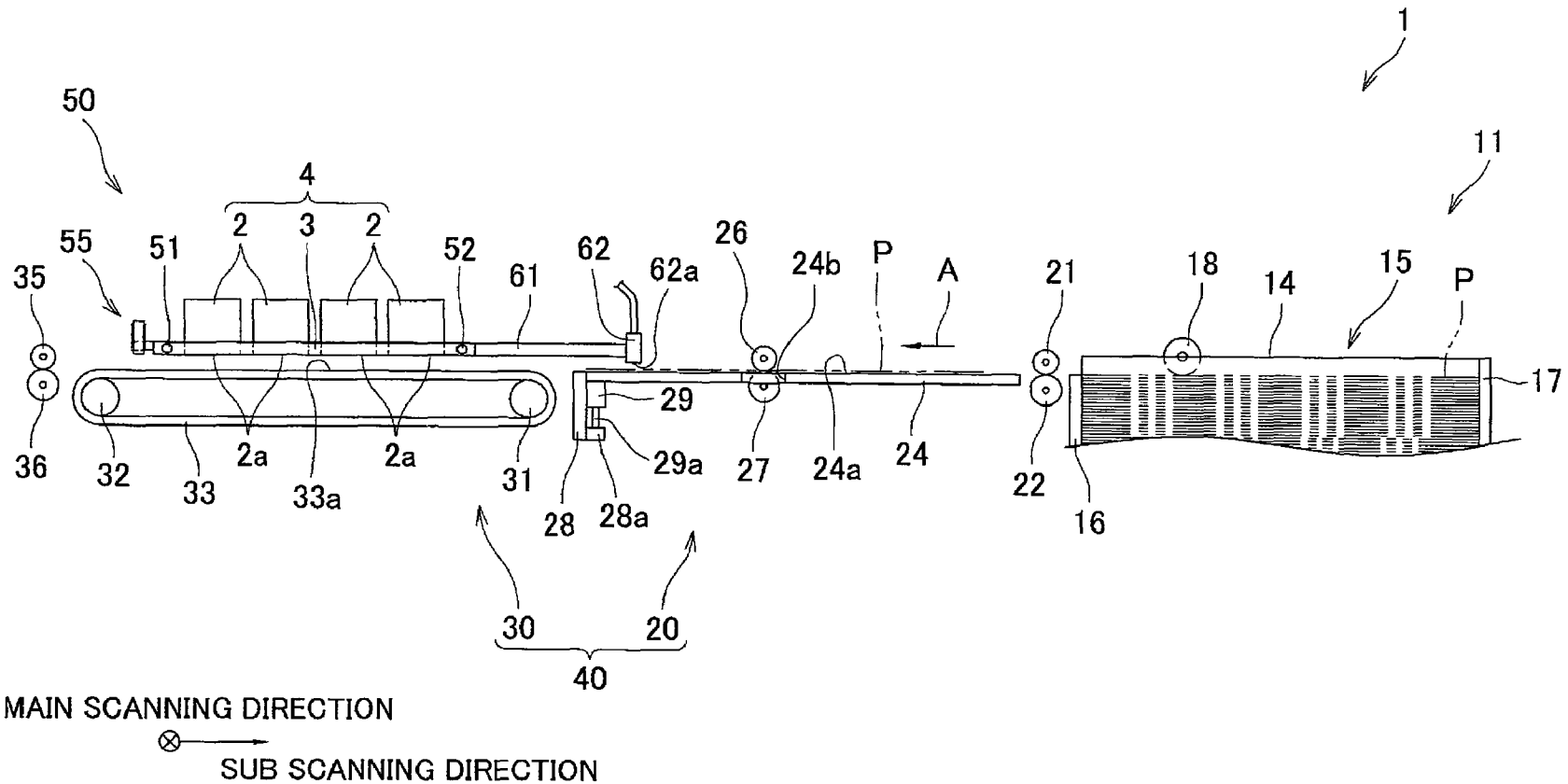
FIG. 2 is a schematic side view of the inkjet printer.

As shown in FIG. 2, the paper feeder 11 includes a tray 15 which is capable of containing a stack of sheets P vertically stacked. As shown in FIG. 1, the tray 15 has: a bottom plate 12 having a rectangular plane shape; a fixed guide plate 13 disposed upright along one side of the bottom plate 12; a movable guide plate 14 disposed upright so as to be movable relative to the bottom plate 12 in the main scanning direction; a fixed guide plate 16 disposed upright at a downstream end of the bottom plate 12 in the conveyance direction A; and a movable guide plate 17 disposed upright so as to be movable relative to the bottom plate 12 in the sub scanning direction.

The fixed guide plate 13 has a guide face 13*a* which extends along the conveyance direction A. The guide face 13*a* abuts one side of a sheet P, i.e., abuts one end 8 of a sheet P in a direction perpendicular to the conveyance direction A, illustrated in FIG. 1. The movable guide plate 14 has a guide face 14*a* which extends along the conveyance direction A. The guide face 14*a* abuts the other side of the sheet P, i.e., abuts the other end 9 of the sheet P in the direction perpendicular to the conveyance direction A, illustrated in FIG. 1. The one side 8 of the sheet P can be aligned with the guide face 13*a* in such a way that a user of the printer 1 moves the movable guide plate 14 to sandwich the sheet P between the movable guide plate 14 and the fixed guide plate 13. Thus, it is possible to adjust the positions of the sides 8, 9 of the sheet P irrespective of the size of the sheet P.

The fixed guide plate 16 has a guide face 16*a* which extends in the main scanning direction and abuts a leading end 7 of the sheet P in the conveyance direction A, illustrated in FIG. 1. As shown in FIG. 2, the upper end of the fixed guide plate 16 is configured to be lower than the respective upper ends of the other guide plates 13, 14, and 17, for the purpose of allowing a sheet P to be discharged from the tray 15. As shown in FIG. 1, the movable guide plate 17 has a guide face 17*a* which extends in the main scanning direction and abuts a rear end of the sheet P. The leading end 7 of the sheet P can be aligned with the guide face 16*a* in such a way that a user of the printer 1 moves the movable guide plate 17 to sandwich the sheet P between the movable guide plate 17 and the fixed guide plate 16. Thus, it is possible to adjust the position of the leading end 7 of the sheet P irrespective of the size of the sheet P.

The paper feeder 11 further includes a pickup roller 18 which contacts, while rotating, a top-most sheet P of the stack of sheets P contained in the tray 15 to convey the sheet P to the conveyer 40. The pickup roller 18 is rotated by driving a not-shown motor controlled by the controller 70.

As shown in FIGS. 1 and 2, the conveyer 40 includes a conveyance mechanism 20 and a conveyance mechanism 30, which are disposed in this order from the upstream of the conveyance direction A. The conveyance mechanism 20 includes: a support table 24 having a plane support face 24*a*; a roller set 21 and a long roller 22 which are disposed between the support table 24 and the paper feeder 11; and a roller set 26 and a long roller 27 which are disposed at a middle of the support table 24. Each of the roller sets 21 and 26 is formed of five rollers successively disposed on an axis along the main scanning direction. The roller 22 is disposed below the roller set 21 so that the circumferential surface of the roller 22 contacts each of the five rollers of the roller set 21. Also, the roller 27 is disposed below the roller set 26 so that the circumferential surface of the roller 27 contacts each of the five rollers of the roller set 26.

In the support table 24, a through-hole 24*b* is formed into which the roller 27 is disposed. The roller 27 is disposed so that the upper end of the circumferential surface of the roller 27 is positioned flush with the support face 24*a* or above the support face 24*a*. Each roller of the roller sets 21 and 26 and the rollers 22 and 27 are rotated by driving a not-shown motor controlled by the controller 70.

A sheet P sent out from the paper feeder 11 is, first, conveyed onto the support table 24 while being gripped between the rollers of the roller set 21 and the roller 22. Then, the sheet P which has been conveyed onto the support table 24 is conveyed toward the conveyance mechanism 30, during which the sheet P is gripped between the rollers of the roller set 26 and the roller 27, while the whole sheet P is supported by the support face 24*a*.

The conveyance mechanism 20 further includes: a stopper 28 which positions the leading end 7 of the sheet P and corrects the misalignment of the sheet P by abutting the leading end 7 on the support face 24*a*; and a solenoid 29 which moves the stopper 28. The solenoid 29 is driven and controlled by the controller 70 so as to take one of a "positioning state" where the upper end of the stopper 28 protrudes upward from the support face 24*a* and a "release state" where the upper end of the stopper 28 does not protrude from the support face 24*a*.

Correcting the misalignment means that, even if the leading end 7 of a sheet P sent out from the paper feeder 11 is oblique to the main scanning direction before the sheet P reaches the stopper 28, the leading end 7 abuts the stopper 28 with the result that the leading end 7 becomes parallel to the main scanning direction and the sides 8 and 9 of the sheet P become parallel to the conveyance direction A.

Figure 4A:
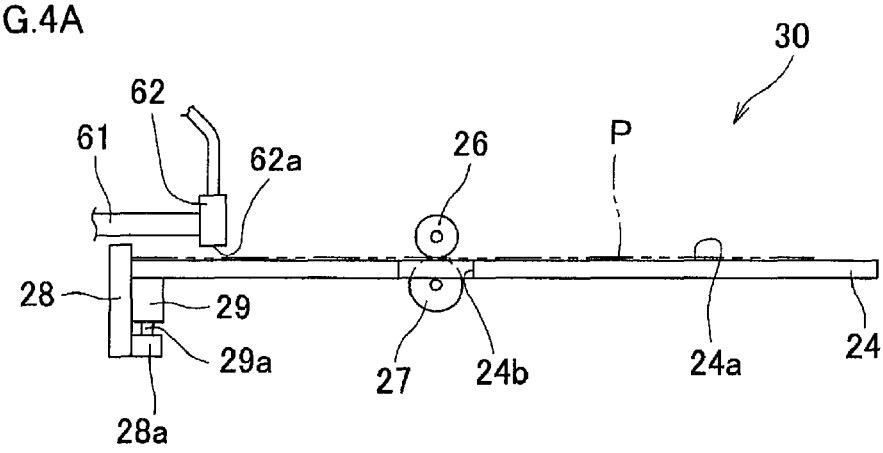
FIG. 4A is a view showing a state where a sheet is positioned on a support face.

The stopper 28 is a plate having its length in the main scanning direction, i.e., being elongated in the main scanning direction, and facing perpendicular to the conveyance direction A, and the stopper 28 is disposed at a downstream end of the support table 24 in the conveyance direction. At a lower end of the stopper 28, there is formed a projection 28*a* fixed to a leading end of a cylinder 29*a* of the solenoid 29. When the cylinder 29*a* extends downward in response to the control of the controller 70 as shown in FIG. 2, the stopper 28 is moved downward, resulting in the release state. On the other hand, when the cylinder 29*a* is retracted as shown in FIG. 4A, the stopper 28 is moved upward, resulting in the positioning state.

The conveyance mechanism 30 has: a pair of belt rollers 31 and 32; a conveyor belt 33 looped around the rollers 31 and 32; a roller set 35 and a long roller 36 which are disposed at downstream from the roller 32 in the conveyance direction. The roller set 35 is formed of five rollers successively disposed on an axis along the main scanning direction. The roller 36 is disposed below the roller set 35 so that the circumferential surface of the roller 36 contacts each of the five rollers.

The belt roller 32 is a drive roller, which is rotated counterclockwise in FIG. 2 by driving a not-shown motor controlled by the controller 70. The belt roller 31 is a driven roller and is rotatably supported by the main body of the printer 1. The surface of the conveyor belt 33 facing the heads 2 is a conveyance face 33*a* which conveys a sheet P. As the roller 32 rotates, the conveyor belt 33 runs so that the conveyance face 33*a* travels in the conveyance direction A. The rollers of the roller set 35 and the roller 36 are rotated using a not-shown motor driven by the control of the controller 70.

A sheet P, which has been conveyed from the support face 24*a* onto the conveyance face 33*a* while being gripped between the rollers of the roller set 26 and the roller 27 of the conveyance mechanism 20, passes through a region facing the heads 2 and travels toward the rollers 35 and 36, as the conveyor belt 33 runs. Then, the sheet P is conveyed to the paper discharger while being gripped between the rollers of the roller set 35 and the roller 36.

The heads 2 correspond to four colors of ink which are magenta, yellow, cyan, and black, respectively. As shown in FIG. 1, each of the heads 2 has, in a plan view, a rectangular shape with its length in the main scanning direction. The heads 2 are aligned in the sub scanning direction, and fixed to the frame 3. The heads 2 and the frame 3 constitute a head unit 4.

Figure 3:
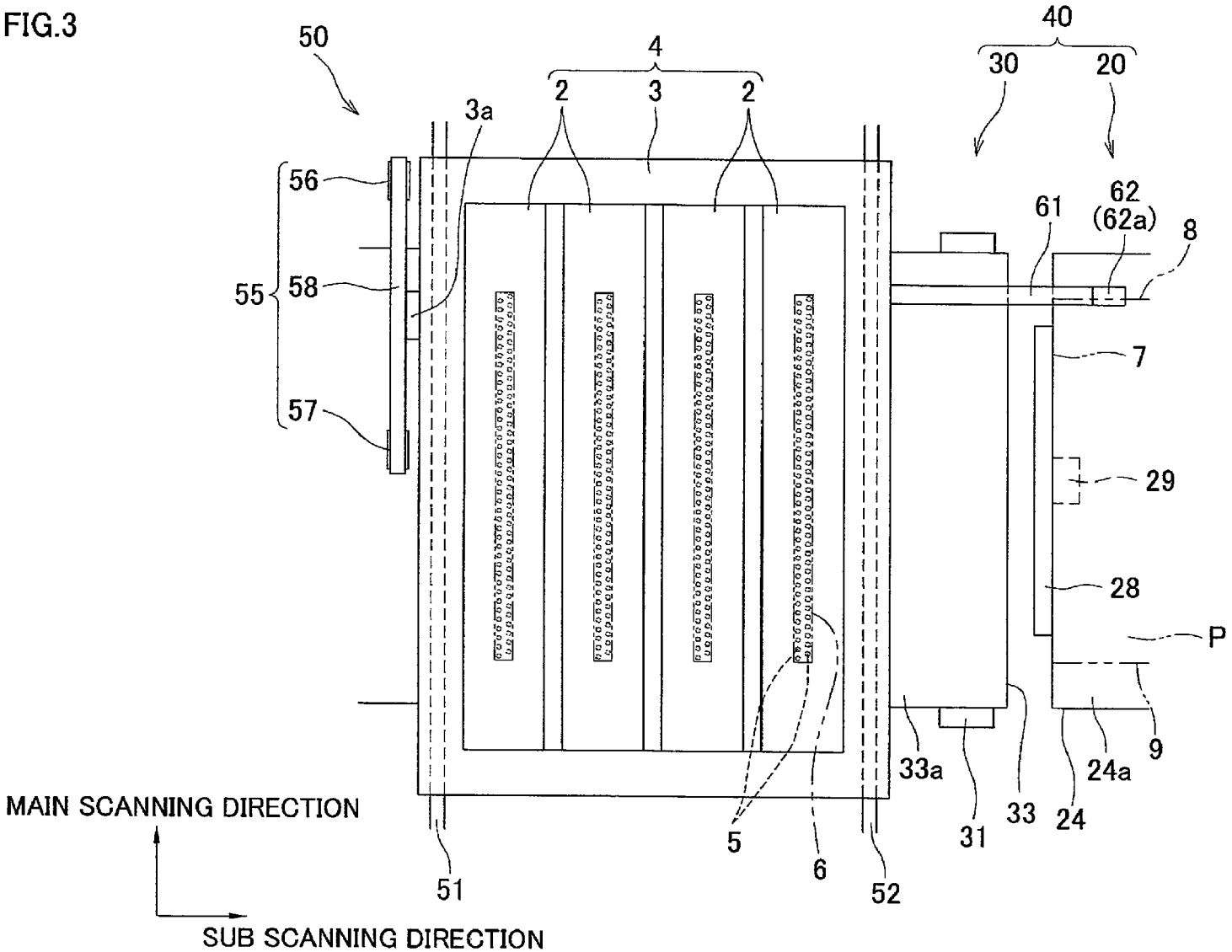
FIG. 3 is an enlarged view of a region enclosed with an alternate long and short dash line in FIG. 1.

As shown in FIG. 3, ejection regions 6 are respectively formed on the surfaces of the heads 2, each facing the conveyor belt 33, which are ejection faces 2*a*. Each ejection region 6 has a plurality of open nozzles 5 arranged in two lines along the main scanning direction. As shown in FIG. 2, the ejection faces 2*a* and the lower face of the frame 3 are disposed at a substantially same level. A not-shown actuator provided to the heads 2 is driven by the control of the controller 70, so that ink is ejected from the nozzles 5.

As shown in FIG. 1, a rod 61 with its length in the sub scanning direction is fixed to an upstream side of the frame 3 in the conveyance direction A. The rod 61 extends to a position facing the support table 24. To a leading end of the rod 61, a photo sensor 62 is fixed. A lower face of the photo sensor 62, that is a detection face 62*a* (see FIG. 2) facing the support face 24*a*, has a light emitter and a light receiver. As shown in FIG. 3, the photo sensor 62 is arranged relative to the heads 2 so that the detection face 62*a* is overlapped with one end of each ejection region 6 in the main scanning direction (hereinafter, one longitudinal end of each ejection region 6) in the main scanning direction. That is, the detection face 62*a* of the photo sensor 62 and the one longitudinal end of each ejection region 6 are aligned in the sub scanning direction. The photo sensor 62 transmits a detection signal to the controller 70 when the photo sensor 62 detects a sheet P on the support table 24.

As shown in FIGS. 1 to 3, the head mover 50 has: two guide rails 51 and 52 which respectively penetrate, in the main scanning direction, the upstream and downstream sides of the frame 3 in the conveyance direction A; and a movement mechanism 55 which moves the head unit 4 and the photo sensor 62 along the guide rails 51 and 52.

As shown in FIG. 3, the movement mechanism 55 includes: a pair of belt rollers 56 and 57 disposed apart from each other in the main scanning direction; and a belt 58 looped around the rollers 56 and 57. The roller 56 is a drive roller and is rotated by driving a not-shown motor controlled by the controller 70. The roller 57 is a driven roller and is rotatably supported by the main body of the printer 1. To a substantial center of the belt 58, there is fixed a protrusion 3*a* protruded from the downstream side of the frame 3 in the conveyance direction A.

Since the frame 3 is fixed to the belt 58 via the protrusion 3*a*, when the roller 56 rotates in a forward direction or reverse direction so that the belt 58 runs, the head unit 4 and the photo sensor 62 move forward or backward in the main scanning direction in FIG. 3.

Figure 4B:
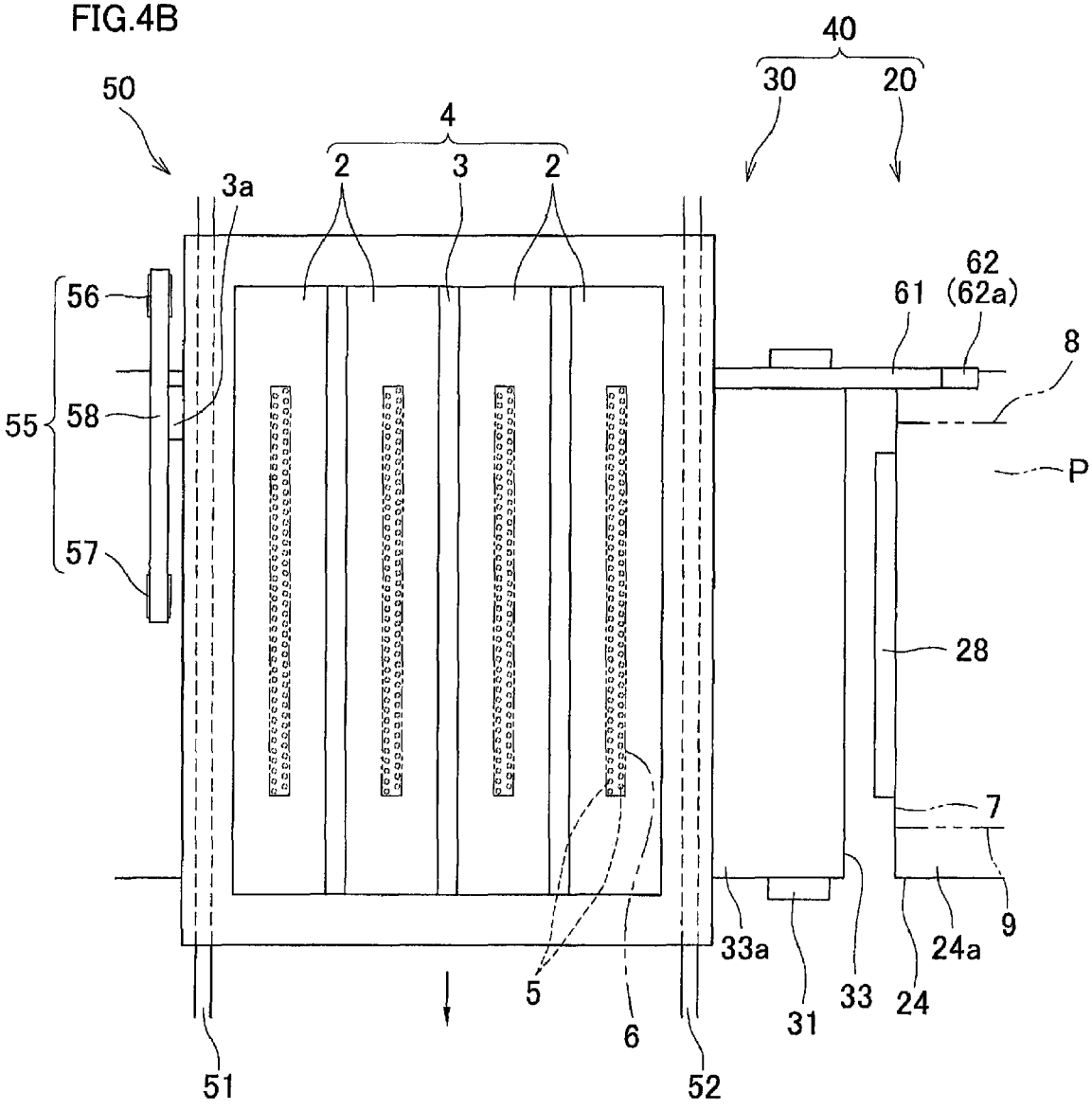
FIG. 4B is a view showing a state before an end of a sheet which has been positioned is detected.

The followings describe the operation of the printer 1 at a time of recording an image on a sheet P, with reference to FIGS. 4A and 4B.

First, a user manually adjusts the positions of the sides 8 and 9 of the sheet P using the guide plates 13 and 14, and adjusts the position of the leading end 7 of the sheet P using the guide plates 16 and 17, in advance. The sheet P, of which position has been adjusted, is sent out in the conveyance direction A by the pickup roller 18, and conveyed on the support table 24 by the rollers of the roller sets 21 and 26, and the rollers 22 and 27. At this time, as shown in FIG. 4A, the cylinder 29*a* of the solenoid 29 has been retracted, so that the solenoid 29 takes the positioning state where the upper end of the stopper 28 protrudes upward from the support face 24*a*. Therefore, the stopper 28 abuts the leading end 7 of the sheet P which has been conveyed. As a result, on the support face 24, the leading end 7 of the sheet P is positioned and misalignment of the sheet P is corrected.

Next, the belt roller 56 of the movement mechanism 55 is rotated in the forward direction to move the head unit 4 and the photo sensor 62 in a direction indicated by an arrow in FIG. 4B. This operation causes the detection face 62*a*, which is positioned to face one end of the support face 24*a* in the main scanning direction but not to face the sheet P, to move toward the one end 8 of the sheet P. When the photo sensor 62 detects the one end 8 of the sheet P, the movement of the head unit 4 by the head mover 50 is stopped at the position in which the detection face 62*a* faces the one end 8 of the sheet P (see FIG. 3). Thus, the one end 8 of the sheet P and the one longitudinal end of each ejection region 6 are in the same position in the main scanning direction. Accordingly, position relation between the sheet P and the ejection regions 6 of the heads 2 are corrected with regard to the main scanning direction, that is, position correction is performed.

Then, the cylinder 29*a* of the solenoid 29 is caused to extend downward by the control of the controller 70, so that the release state is achieved where the upper end of the stopper 28 is not protruded from the support face 24*a*. After that, the sheet P is conveyed onto the conveyor belt 33 by the rollers of the roller set 26 and the roller 27. Further, as the conveyor belt 33 runs, the sheet P is conveyed to a region where the sheet P vertically faces the heads 2. When the sheet P passes immediately below the heads 2, ink is ejected, by the control of the controller 70, from the nozzles 5 of the heads 2 sequentially from the head 2 located most upstream in the conveyance direction A. As a result, an image is recorded at a desired position on the sheet P. The sheet P having the recorded image is conveyed toward the rollers 35 and 36 as the conveyor belt 33 runs. Then, the sheet P is discharged to the paper discharger by the rollers 35 and 36.

After the recording on the one sheet P is thus finished and before a new sheet P is sent out from the paper feeder 15 onto the support table 24, the controller 70 controls the roller 56 of the movement mechanism 55 so as to rotate the roller 56 in the reverse direction. Because of this operation, the head unit 4 and the photo sensor 62 move to the original position, that is, the position in which the detection face 62*a* faces the one end of the support face 24*a* but does not face a sheet P to be placed next.

As described above, according to the inkjet printer 1 of this embodiment, even if a sheet P being conveyed is deviated to the main scanning direction before the recording is conducted by the heads 2, the heads 2 are moved in accordance with the position of the one end 8 of the sheet P, which position is detected by the photo sensor 62, so that position correction is performed. Therefore, misalignment or crease of the sheet P is avoided, which may occur when the position is corrected by sliding a pair of rollers which grip the sheet P therebetween. This makes it possible to conduct recording at a desired position on the sheet P.

The heads 2 are moved so that the one end 8 of a sheet P and the one longitudinal end of each ejection region 6 are in the same position in the main scanning direction. This enables precise recording to be conducted at a desired position on the sheet P.

The leading end 7 of a sheet P conveyed from the support table 24 has been positioned by the stopper 28 on the support table 24. Therefore, the leading end 7 and the nozzles 5 are the same distance apart along their whole length in the main scanning direction of the sheet P. Because of this, the timing when the leading end 7 of the sheet P faces the ejection faces 2*a* is substantially same in whichever part of the leading end 7 in the main scanning direction. Accordingly, precise recording at a desired position on the sheet P is further surely realized.

Since the stopper 28 is an elongated plate, it is possible to perform positioning of the leading end 7 of a sheet P and misalignment correction of the sheet P simultaneously.

As a component which detects the one end 8 of a sheet P, the simple photo sensor 62 which moves along with the heads 2 is used, so that a simple structure is achieved.

After recording on a sheet P is finished and before recording on a next sheet P is started, the sensor 62 is moved to a position in which the detection face 62*a* faces the one end of the support face 24*a* but does not face a sheet P to be placed next. Thus, it becomes possible to quickly detect the one end 8 of a sheet P fed from the paper feeder 15 when continuous recording is performed.

As shown in FIG. 3, the photo sensor 62 is arranged relative to the heads 2 so that the detection face 62*a* is overlapped with the one longitudinal end of each ejection region 6 in the main scanning direction. With this arrangement, when the photo sensor 62 detects the one end 8 of a sheet P, the one end 8 of the sheet P and the one longitudinal end of each ejection region 6 are in the same position in the main scanning direction.

Before a sheet P is sent out from the paper feeder 11, a user of the printer 1 can move the movable guide plate 14 so that the sheet P is sandwiched between the movable plate guide 14 and the fixed guide plate 13, thereby adjusting the positions of the sides of the sheet P. This adjustment decreases the probability of large deviation to the main scanning direction of the sheet P sent out from the paper feeder 11, resulting in reduction in distance of movement of the heads 2.

Since the above-described embodiment deals with the case where the detection face 62*a* and the one end of each ejection region 6 are overlapped with each other in the main scanning direction, the movement of the head unit 4 is stopped when the photo sensor 62 detects the one end 8 of a sheet P. However, even in the case where, for example, the detection face 62*a* and the one end of each ejection region 6 are not overlapped with each other in the main scanning direction and the detection face 62*a* is shifted toward the center of each ejection region 6 in the main scanning direction, the shift is compensated only by moving the head unit 4 for a distance corresponding to the shift after the photo sensor 62 detects the one end 8 of a sheet P. Meanwhile, in the case where the detection face 62*a* and the one end of each ejection region 6 are not overlapped with each other in the main scanning direction and the detection face 62*a* is shifted so as to be apart from the one end of each ejection region 6 toward the upper side in FIG. 3, the shift is compensated by stopping the movement of the head unit 4 when the photo sensor 62 detects the one end 8 of the sheet P, and then moving the head unit 4 for a distance corresponding to the shift in the opposite direction to the above-mentioned direction. Also in these cases, the one end 8 of the sheet P and the one end of each ejection region 6 become in the same position in the main scanning direction, and this enables precise recording to be conducted at a desired position on the sheet P.

The photo sensor 62 is not limited to being movable along with the heads 2. The photo sensor 62 may be movable independently of the heads 2. In addition, instead of the photo sensor 62, a line sensor may be used, which extends in the main scanning direction on the support table 24. In these cases, the heads 2 are moved in the main scanning direction so that each ejection region 6 faces a desired position of a sheet P, in accordance with the position detected by such a photo sensor or line sensor.

It is not limitative that the heads 2 are moved so that the one end 8 of a sheet P and the one end of each ejection region 6 are in the same position in the main scanning direction. For example, the heads 2 may be moved so that the one end of each ejection region 6 and a predetermined position of the sheet P are in the same position in the main scanning direction.

The conveyer 40 may have various configurations as long as it is capable of conveying a sheet P in the conveyance direction A. For example, the conveyer 40 may be constituted of the conveyance mechanism 30 only. In this case, the one end 8 of the sheet P can be detected when the sheet P is conveyed by the conveyance mechanism 30 or when the conveyance of the sheet P is temporarily stopped. Then, the heads 2 are moved in accordance with the detected position of the sheet P. Alternatively, the conveyer 40 may have a platen which adsorbs and holds a sheet P sent out from the paper feeder 11 and is capable of moving in the conveyance direction A. Also in this case, the one end 8 of a sheet P can be detected when the sheet P is adsorbed and held, or when the sheet P is conveyed. Then, in accordance with the detected position of the sheet P, the heads 2 are moved.

Instead of the stopper 28, a pair of opposed rollers may be used for example, as a member which positions the leading end 7 of a sheet P. In this case, it is preferable to move one of the rollers located above the support face 24*a* to a withdrawal position in which the roller does not interfere with the rod 61 and the photo sensor 62, before the head unit 4 and the like is moved and after the leading end 7 of the sheet P is positioned on the support face 24*a*.

The stopper 28, the solenoid 29, or the like may be omitted, and positioning of the leading end 7 of a sheet P does not necessarily have to be performed on the support table 24.

The head unit 4 and the photo sensor 62 may be moved to the respective original positions after a next sheet P is sent out from the paper feeder 15.

The movable guide plate 14 may be omitted from the paper feeder 15.

The inkjet recording apparatus according to the present invention is not limited to an inkjet printer, but is applicable to a copying machine, a facsimile machine, and other various recording apparatuses.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An inkjet recording apparatus, comprising:

a feeder configured to contain a recording medium and configured to feed the recording medium to a conveyor, wherein the conveyor is configured to convey the recording medium fed by the feeder in a first direction;

an inkjet head comprising an ejection face on which an ejection region is formed, the ejection region having a plurality of ink ejection openings arranged along a second direction perpendicular to the first direction, wherein the length of the ejection region in the second direction is greater than the length of the ejection region in the first direction;

a detection unit configured to detect one end of the recording medium in the second direction;

a mover configured to move the inkjet head in the second direction in accordance with the position of the one end of the recording medium detected by the detection unit, and a controller configured to control the feeder, the conveyor, the inkjet head, and the mover, wherein:

the detection unit comprises a sensor moved along with the inkjet head by the mover, the sensor having a detection face which detects the recording medium;

the controller is configured to control the mover to move the inkjet head and the sensor from a first position in which the detection face does not face the one end of the recording medium to a second position in which the detection face faces the one end of the recording medium, and to stop the inkjet head and the sensor at the second position; and the controller is configured to control the conveyor and the inkjet head, when the inkjet head and the sensor are stopped at the second position, such that ink is ejected from the ink ejection openings onto the recording medium when the recording medium is conveyed by the conveyor and passes through a recording position in which the recording medium faces the ejection face.

2. The inkjet recording apparatus according to claim 1, wherein the controller is configured to control the mover to move the inkjet head, such that the one end of the recording medium and one end of the ejection region in the second direction are in a same position in the second direction.

3. The inkjet recording apparatus according to claim 1, wherein:

the conveyor comprises a first conveyance mechanism which conveys the recording medium to the recording position, and a second conveyance mechanism which is positioned between the first conveyance mechanism and the feeder; and the second conveyance mechanism comprises a support table which supports the recording medium fed from the feeder, a roller which conveys the recording medium from the support table to the first conveyance mechanism, and a positioner which selectively takes one of a positioning state to position a leading end of the recording medium in the first direction on the support table and a release state not to position the leading end.

4. The inkjet recording apparatus according to claim 3, wherein the positioner comprises a plate which is elongated in the second direction and abuts the leading end of the recording medium in the positioning state.

5. The inkjet recording apparatus according to claim 1, wherein the controller is configured to control the mover to move the inkjet head and the sensor from the second position to the first position after recording on the recording medium is finished and before another recording medium is fed from the feeder.

6. The inkjet recording apparatus according to claim 1, wherein the sensor is arranged relative to the inkjet head, such that the detection face is overlapped with the one end of the ejection region in the second direction.

7. The inkjet recording apparatus according to claim 1, wherein the feeder comprises:

a fixed guide member having a guide face which extends in the first direction and abuts the one end of the recording medium; and a movable guide member having a guide face which extends in the first direction and abuts an other end of the recording medium, the movable guide member configured to move so as to sandwich the recording medium with the fixed guide member.

* * * * *